United States Patent [19]

Pettorino

[11] 4,407,264

[45] Oct. 4, 1983

[54] ADJUSTABLE FRESH AIR DAMPER FOR COMBUSTION

[76] Inventor: Arthur J. Pettorino, 9 Wilshire Dr., Syosset, N.Y. 11791

[21] Appl. No.: 326,538

[22] Filed: Dec. 2, 1981

[51] Int. Cl.[3] ..... F24B 1/18

[52] U.S. Cl. ..... 126/120; 126/143; 126/288; 126/285 A

[58] Field of Search ..... 126/120, 121, 143, 288, 126/285 A, 318; 237/51

[56] References Cited

U.S. PATENT DOCUMENTS

| | | | |
|---|---|---|---|
| 948,007 | 2/1910 | Doane | 126/120 |
| 980,304 | 1/1911 | Ljungberg | 126/318 |
| 2,003,154 | 5/1935 | Menough | 126/285 A |
| 4,106,475 | 8/1978 | Mayes | 126/143 |
| 4,248,206 | 2/1981 | Orthey, Jr. | 126/143 |

*Primary Examiner*—James C. Yeung
*Attorney, Agent, or Firm*—Michael I. Kroll

[57] ABSTRACT

An adjustable fresh air damper for combustion air is provided. Said invention consists of a front plate having a central aperture, an air intake plate having a plurality of apertures and means for holding the front plate against a firebrick inner wall and the air intake plate against an outer wall of a rear wall of a fireplace having an aperture therethrough. A slide door is provided that is gravity operated with a means for guiding the slide door affixed to the front plate so that the slide door can go to an up position exposing the central aperture in the front plate allowing ambient outside fresh air to enter the fireplace and the slide door can go to a down position covering the central aperture in the front plate preventing ambient outside fresh air from entering the fireplace.

3 Claims, 4 Drawing Figures

ADJUSTABLE FRESH AIR DAMPER FOR COMBUSTION

BACKGROUND OF THE INVENTION

The instant invention relates generally to fireplaces and more specifically it relates to an adjustable fresh air damper for combustion for use in home wood burning fireplaces.

Currently the New York State building code requires all new construction for fireplaces to have as its source of combustion air ambient outside fresh air as opposed to inside room temperature air. Accordingly new fireplace construction must have: (1) air tight doors to cover the front of the fireplace in order to keep room air out; and (2) a separate source of outside air for combustion.

SUMMARY OF THE INVENTION

A principle object of the present invention is to provide an adjustable fresh air damper for combustion air that will allow ambient outside fresh air to enter a fireplace for use as combustion air.

Another object is to provide an adjustable fresh air damper for combustion that will prevent ambient outside fresh air to enter a fireplace when not in use.

An additional object is to provide an adjustable fresh air damper for combustion that can be placed into existing fireplaces.

A further object is to provide an adjustable fresh air damper for combustion that can be placed into new construction of fireplaces.

A still further object is to provide an adjustable fresh air damper for combustion that is safe to operate in that the operator may easily and safely open, close and adjust the damper without danger of burning one's hands.

Further objects of the invention will appear as the description proceeds.

To the accomplishment of the above and related objects this invention may be embodied in the form illustrated in the accompanying drawings attention being called to the face, however, that the drawings are illustrative only and that changes may be made in the specific construction illustrated and described within the scope of the appended claims.

DESCRIPTION OF THE PREFERRED EMBODIMENTS

Figure 1:
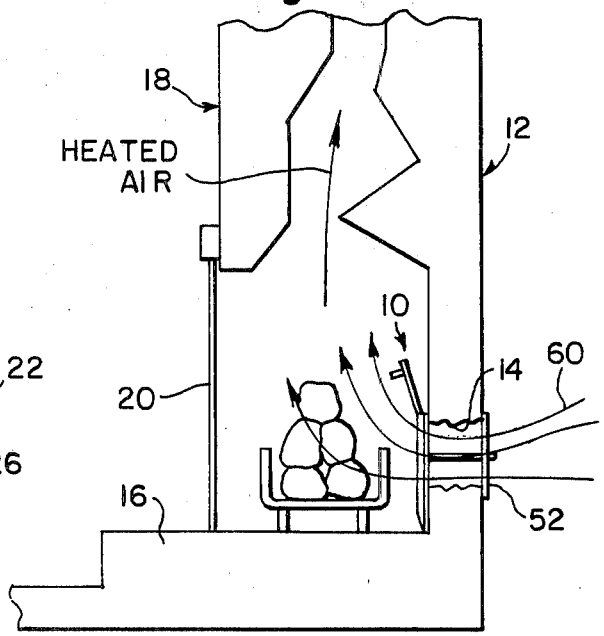
FIG. 1 is a diagrammatic cross sectional side view of a fireplace with the invention in place.

Referring to FIG. 1 of the drawing an adjustable fresh air damper for combustion is provided generally designated 10. The damper 10 is mounted into the rear wall 12 having a aperture 14 near the hearth 16 of a fireplace 18. An air tight glass door 20 is placed at the front of the fireplace 18 to keep the inside room temperature air from entering the fireplace.

Figure 2:
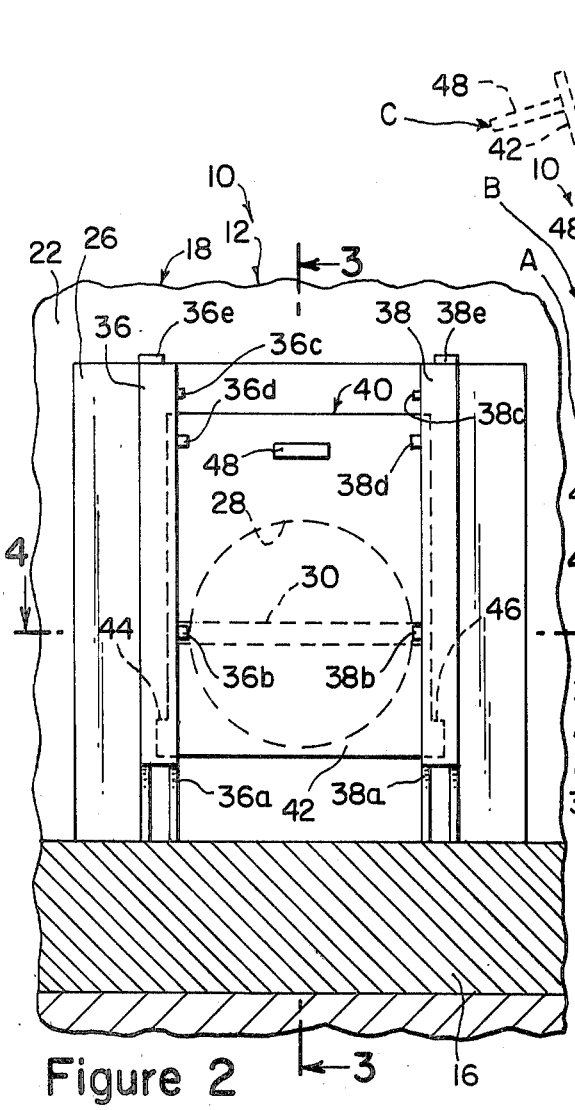
FIG. 2 is a front view of the invention.
Figure 3:
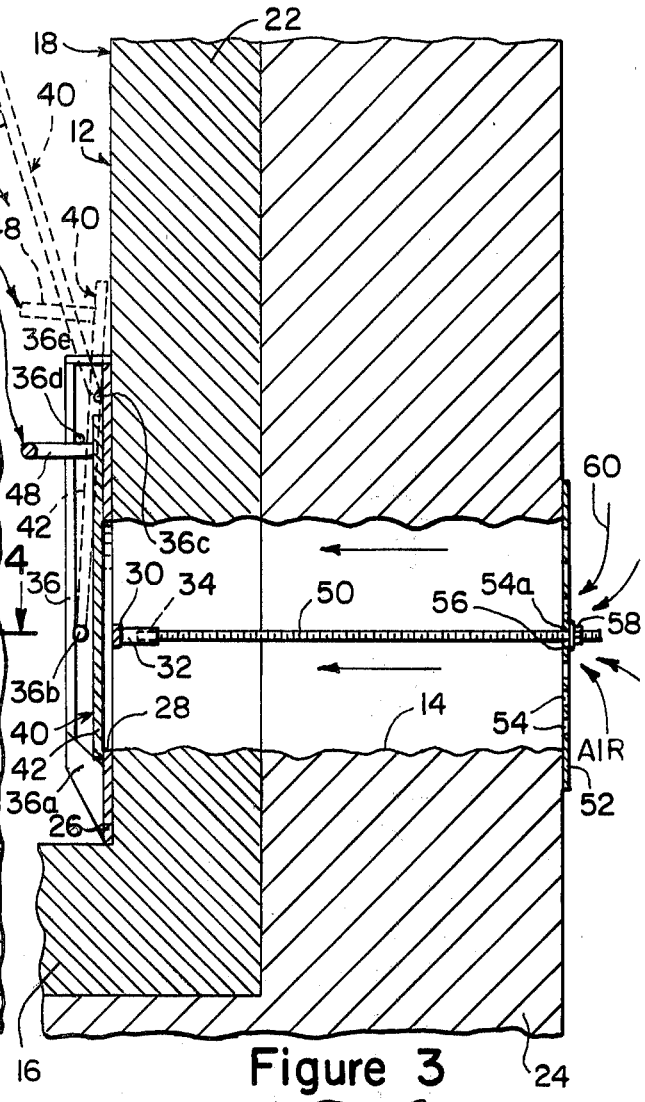
FIG. 3 is a cross sectional view taken along line 3—3 in FIG. 2.
Figure 4:
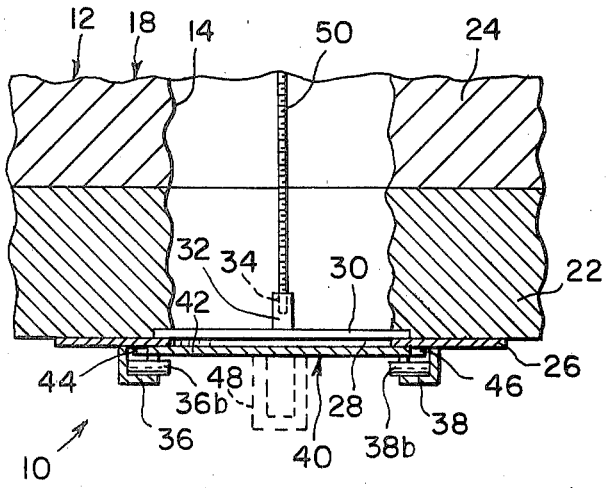
FIG. 4 is a cross sectional view taken along line 4—4 in FIG. 2.

FIGS. 2, 3 and 4 show the invention in greater detail. The rear wall 12 of the fireplace 18 consists of a firebrick inner wall 22 and an outer wall 24. The damper 10 consists in part of a front plate 26 having a central aperture 28. A cross bar 30 has each end affixed to the rear surface of the front plate 26 across the central aperture 28. The cross bar 30 contains a central boss 32 having a threaded aperture 34 perpendicular to the long axis of the cross bar 30 and facing rearward as best seen in FIG. 4.

A pair of guide rails 36 and 38 are mounted vertically to the front surface of the front plate 26 to the left and right of the central boss 32 as best seen in FIG. 2.

A slide door 40 that is gravity operated is placed between the guide rails 36 and 38. The slide door 40 consists of a plate 42 that has a left tab 44 affixed to the lower left corner, a right tab 46 affixed to the lower right corner and a "U" shaped handle 48 affixed perpendicular to the upper central portion of the plate 42 so that a fireplace poker (not shown) can engage the "U" shaped handle 48 to raise and lower the slide door 40.

The left guide rail 36 has three stops namely **36*a*, 36*b* and 36*c* so that left tab 44 of the slide door 40 may be oriented in three different positions in conjunction with the right guide rail. The right guide rail 38 also has three stops 38*a*, 38*b* and 38*c* so that the right tab 46 of the slide door 40 may be oriented in the same three positions in conjunction with the left guide rail, as best seen in FIG. 3. Guide rails 36 and 38 also have guides 36*d* and 38*d* to prevent the slide door 40 from moving too far away from the front surface of the front plate 26 when moving up and down. Top stops 36*e* and 38*e* are provided to prevent the slide door 40 from exiting guide rails 36 and 38**.

A rod 50 having a threaded end is placed into threaded aperture 34 of the central boss 32 of the cross bar 30. The front plate is placed against the firebrick inner wall 22 of the rear wall 12 having an aperture 14. The rod 50 protrudes beyond the outer wall 24 so that an air intake plate 52 having a plurality of apertures 54 can be placed onto the rod 50 through its center aperture **54*a* against the outer wall 24. A washer 56 and nut 58 is placed onto the rod 50 and tightened until the front plate 26 and air intake plate 52 are secured to the rear wall 12**.

When the fresh air damper 10 is mounted in the rear wall 12 the slide door 40 can be placed in three different positions as best seen in FIG. 3. The first position A is the closed position allowing no ambient outside fresh air 60 to enter the fireplace 18. In this position the tabs 44 and 46 contact the first stops **36*a* and 38*a* causing the slide door 40 to block the entire central aperture 28 in the front plate 26. The second position B is the half-opened position allowing some ambient outside fresh air 60 to enter the fireplace 18. In this position the tabs 44 and 46 contact and rest on the second stops 36*b* and 38*b* causing the slide door 40 to block half of the central aperture 28 in the front plate 26. The third position C is the completely opened position allowing ambient outside fresh air 60 to enter the fireplace 18. In this position the tabs 44 and 46 contact and rest on the third stops 36*c* and 38*c* causing the slide door 40 to tip forward and be positioned above the central aperture 28 in the front plate 26**.

To close the slide door 40 from position B one takes a fireplace poker and pushes the bottom of the slide door 40 until it disengages from stops **36*b* and 38*b* and drops down to the first stops 36*a* and 38*a*. To close the slide door 40 from position C one takes the poker and pushes the top of the slide door back so that it disengages from stops 36c and 38c and drops down by gravity to the first stops 36a and 38a**.

The fresh air damper 10 may be made of any fireproof material such as metal, etc. but is preferably made from carbon steel with the component parts being welded together for structural integrity.

Having regard to the foregoing disclosure the following is claimed as the inventive and patentable embodiments thereof:

1. An adjustable fresh air damper for combustion which comprises:

(a) a front place having a central aperture;

(b) an air intake plate having a plurality to apertures;

(c) a means for holding said front plate against a firebrick inner wall and said air intake plate against an outer wall of a rear wall of a fireplace having an aperture therethrough, said means comprising:

(1) a cross bar with a central boss having a threaded aperture perpendicular to the long axis of said cross bar and facing rearward with each end of said cross bar affixed to said front plate across said central aperture;

(2) a rod with a threaded end placed into said threaded aperture of said central boss of said cross bar and a second threaded end placed through said middle aperture to said air intake plate;

(3) a washer placed onto said second threaded end of said rod; and (4) a nut threaded onto said second threaded end of said rod;

(d) a slide door that is gravity operated; and (e) a means for guiding said slide door, affixed to said front plate, so that said slide door can go to an up position exposing said central aperture in said front plate allowing ambient outside fresh air to enter said fireplace and said slide door can go to a down position covering said central aperture in said front plate preventing ambient outside fresh air to enter said fireplace.

2. An adjustable fresh air damper for combustion as recited in claim 1, wherein said slide door comprises:

(a) a plate;

(b) a left tab affixed to lower left corner of said plate;

(c) a right tab affixed to lower right corner of said plate; and (d) a "U" shaped handle affixed perpendicular to upper central portion of said plate so that a fireplace poker can engage said "U" shaped handle to raise and lower said slide door.

3. An adjustable fresh air damper for combustion as recited in claim 1, wherein said means for guiding said slide door comprises:

(a) a left guide rail mounted vertically on said front plate;

(b) a plurality of stops affixed to said left guide rail to place said left tab of said slide door in a plurality of different positions;

(c) a right guide rail mounted vertically on said front plate; and (d) a plurality of stops affixed to said left guide rail to place said right tab of said slide door in a plurality of different positions.

* * * * *